US009447624B2

(12) United States Patent
Nakano

(10) Patent No.: US 9,447,624 B2
(45) Date of Patent: Sep. 20, 2016

(54) STEP PLATE MECHANISM FOR DOOR OPENING AND CLOSING DEVICE

(75) Inventor: Yasuo Nakano, Fukushima (JP)

(73) Assignees: Yasuo Nakano, Tamura-shi (JP); miimo LTD., Tokyo (JP)

( * ) Notice: Subject to any disclaimer, the term of this patent is extended or adjusted under 35 U.S.C. 154(b) by 0 days.

(21) Appl. No.: 14/116,819

(22) PCT Filed: May 11, 2012

(86) PCT No.: PCT/JP2012/062212

§ 371 (c)(1),
(2), (4) Date: Apr. 22, 2014

(87) PCT Pub. No.: WO2012/153852

PCT Pub. Date: Nov. 15, 2012

(65) Prior Publication Data

US 2014/0311032 A1 Oct. 23, 2014

(30) Foreign Application Priority Data

May 11, 2011 (JP) ..... 2011-106537
May 11, 2011 (JP) ..... 2011-106538

(51) Int. Cl.

| | |
|---|---|
| ***E05F 13/02*** | (2006.01) |
| ***E05F 13/04*** | (2006.01) |
| ***E05F 1/02*** | (2006.01) |
| ***E05F 1/16*** | (2006.01) |
| ***E05F 11/54*** | (2006.01) |

(52) U.S. Cl.
CPC ..... *E05F 13/02* (2013.01); *E05F 1/02* (2013.01); *E05F 1/16* (2013.01); *E05F 11/54* (2013.01); *E05F 13/04* (2013.01)

(58) Field of Classification Search
CPC ..... E05F 13/04; E05F 13/00; E05F 1/02; E05F 1/04; E05F 1/046; E05F 13/02
See application file for complete search history.

(56) References Cited

U.S. PATENT DOCUMENTS

| | | | | |
|---|---|---|---|---|
| 368,661 | A * | 8/1887 | Estes | 49/274 |
| 717,705 | A * | 1/1903 | McCarville | 160/4 |
| 1,366,236 | A * | 1/1921 | Albrecht, Jr. | 49/103 |
| 1,441,116 | A * | 1/1923 | Rollman | 49/106 |
| 2,713,737 | A * | 7/1955 | Hawkins | 49/271 |
| 3,256,637 | A * | 6/1966 | Torrey | 49/104 |
| 6,115,964 | A * | 9/2000 | Hix | 49/134 |
| 7,861,461 | B2 * | 1/2011 | Nakano | 49/231 |

FOREIGN PATENT DOCUMENTS

| | | |
|---|---|---|
| JP | H07208016 A | 8/1995 |
| JP | 2005007550 A | 1/2005 |

* cited by examiner

*Primary Examiner* — Katherine Mitchell
*Assistant Examiner* — Marcus Menezes
(74) *Attorney, Agent, or Firm* — Greer, Burns & Crain, Ltd.

(57) ABSTRACT

A step-plate mechanism is provided for a door-opening/closing device that is powered by the downward movement of a step plate caused by a stepping force of a pedestrian, with the step plate being disposed on a floor at both the front and back of a door as seen by a pedestrian, including a return mechanism is provided to bias the step plate, which moves downward by the stepping force of the pedestrian, to return to its original position after the pedestrian passes.

3 Claims, 7 Drawing Sheets

STEP PLATE MECHANISM FOR DOOR OPENING AND CLOSING DEVICE

FIELD OF THE INVENTION

The present invention relates to a step-plate mechanism for a door-opening/closing device, and more precisely, to a step-plate mechanism that is powered by the stepping force of a pedestrian, wherein, after the pedestrian has passed, a return mechanism inside the step-plate mechanism closes the opened door.

BACKGROUND OF THE INVENTION

In general, a conventional door-opening/closing device operated electrically does not respond if a pedestrian approaches the device too slowly. If a pedestrian stops walking, the device closes the door even if the pedestrian is in the area within which the device senses the presence of a human (hereinafter "device's detection area"). Also, if there is a power outage, the door that the device is to operate, together with the device's drive unit, needs to be moved by human power so as to open or close the door, which requires a large amount of human force. In order to prevent such operational failure and the resulting need for human force to be applied, a conventional device requires not only a source of primary electricity but also a source of backup electricity. In addition, a conventional device has many disadvantages, such as the adverse effects on human bodies and on precision equipment near the device of the electromagnetic waves used for the device's sensor.

In order to eliminate the above-mentioned disadvantages, many door-opening/closing devices that do not use electricity but use the potential energy obtained by the downward movement of a step plate stepped on by a pedestrian have been invented. In many of these devices, a door opening/closing mechanism is disposed on the floor, as well as in a door pocket and/or a transom, and therefore such a device requires a large space.

One example of the prior art is the door-opening/closing device described in Patent Document 1 (see FIG. 8). This door-opening/closing device has a mechanism such that a portion—specifically the portion that is immediately beneath a door—of a step plate is raised, and such that the front and rear ends—as seen by an pedestrian—of the step plate are affixed to the floor by hinges. The force by which the step plate is restored to its original raised position after having been stepped on is interlocked with a door-closing force. But this has the disadvantage of requiring a large space in the door's transom. Another disadvantage is that the acting force obtained from the stepping force varies depending on the specific position stepped on by a pedestrian.

The door-opening/closing device described in Patent Document 2 (see FIG. 9) has no mechanism in the door's transom, but it has a large mechanism in the door pocket. This large space needs to be taken into consideration when designing a building.

PRIOR-ART DOCUMENTS

Patent Documents

Patent Document 1: Japanese Unexamined Patent Application Publication No. H7-208016

Patent Document 2: Japanese Utility Model Application No. 2005-7550

BRIEF DESCRIPTION OF THE INVENTION

Problems to be Solved by the Invention

A conventional door-opening/closing device that is operated by the weight of a pedestrian includes a step-plate mechanism on the floor and a drive mechanism in a door pocket and/or a door's transom. Because such mechanisms require large spaces, it is difficult to install a conventional door-opening/closing device in a building. Accordingly, one objective of the present invention is to provide a step-plate mechanism for a door-opening/closing device that is operable in a smaller space, is easy to install, and wherein the thickness of the step-plate mechanism is reduced and there is included a self-return configuration in which a step plate moves downward due to the load of a pedestrian and automatically rises back after the pedestrian passes.

Means for Solving the Problems

A (the first) step-plate mechanism for a door-opening/closing device according to the present invention is described as:

- a step-plate mechanism for a door-opening/closing device that is powered by the downward displacement of a step plate due to the stepping force of a pedestrian, with a step plate being disposed on the floor at both the front and back sides of a door (front and back as seen by a pedestrian);
- wherein a return mechanism is provided to bias the step plate, which moves downward due to the stepping force of the pedestrian, to return to its original position after the pedestrian passes.

Another (the second) step-plate mechanism for a door-opening/closing device according to the present invention is described as:

- a step-plate mechanism according to the above first step-plate mechanism;
- and wherein the step-plate mechanism further includes
  - the step plate having plural bearings,
    - multiple links, one end of each of which is coupled to one of the bearings of the step plate, and
    - bearings, disposed in a metal part fixed on the floor, each of which is coupled to the other end of each of said links;
- wherein the step plate, while remaining horizontal, moves downward and arcuately in the direction in which the pedestrian is moving; and
- wherein the return mechanism biases the links, whose angles have been displaced in the downward direction due to the load of the pedestrian, to return to their original angles.

Another (the third) step-plate mechanism for a door-opening/closing device according to the present invention is described as:

- a step-plate mechanism according to the above second step-plate mechanism;
- and wherein two step plates are provided, one step plate having an interlock guide, and the other step plate having an interlock-guide receiving member that is slidably connected to the interlock guide; and
- wherein, when the one step plate moves downward in a constant displacement, the other step plate also moves downward in a line-symmetric, constant displacement with the door as a symmetrical axis.

Another (the fourth) step-plate mechanism for a door-opening/closing device according to the present invention is described as:

a step-plate mechanism according to the above second or third step-plate mechanisms;

and wherein the return mechanism comprises a link extender in which the other end of each of said links is extended in the direction opposite from the step plate, and a weight that is axially supported on the end of the extended part of the link extender; and wherein the weight rises when a pedestrian steps on the step plate, causing the step plate to move downward, and then moves downward due to its own weight and causes the step plate to rise when the pedestrian steps off the step plate.

Another (the fifth) step-plate mechanism for a door-opening/closing device according to the present invention is described as:

a step-plate mechanism according to any one of the above first, second, or third step-plate mechanisms;

and wherein the return mechanism includes bearings mounted to metal parts, fixed on the floor, of the step plate, and a torsion spring mounted coaxially with one of the bearings to a shaft disposed in the metal parts; and wherein the torsion spring accumulates a biasing force when a pedestrian steps on the step plate, causing the step plate to move downward, and the torsion spring releases the biasing force to cause the step plate to rise when the pedestrian steps off the step plate.

Another (the sixth) step-plate mechanism for a door-opening/closing device according to the present invention is described as:

a step-plate mechanism according to any one of the above first to third step-plate mechanisms;

and wherein the door is an overhung door whose upper end is slidably hung on an overhung-door rail, and the overhung-door rail is inclined downward in either the door's opening direction or the door's closing direction.

Effects of the Invention

Because a step-plate mechanism for a door-opening/closing device according to the present invention does not need large spaces in the floor at the front and back of a door, a door pocket, and/or a transom, it is easy to install.

EMBODIMENTS FOR CARRYING OUT THE INVENTION

The present invention's step-plate mechanism for a door-opening/closing device will now be explained in detail with reference to the drawings. The present invention's step-plate mechanism for a door-opening/closing device does not need large spaces of the floor at the front and back sides of a door, nor a door pocket, nor a transom, and it is easy to install.

Embodiment 1

Figure 1:
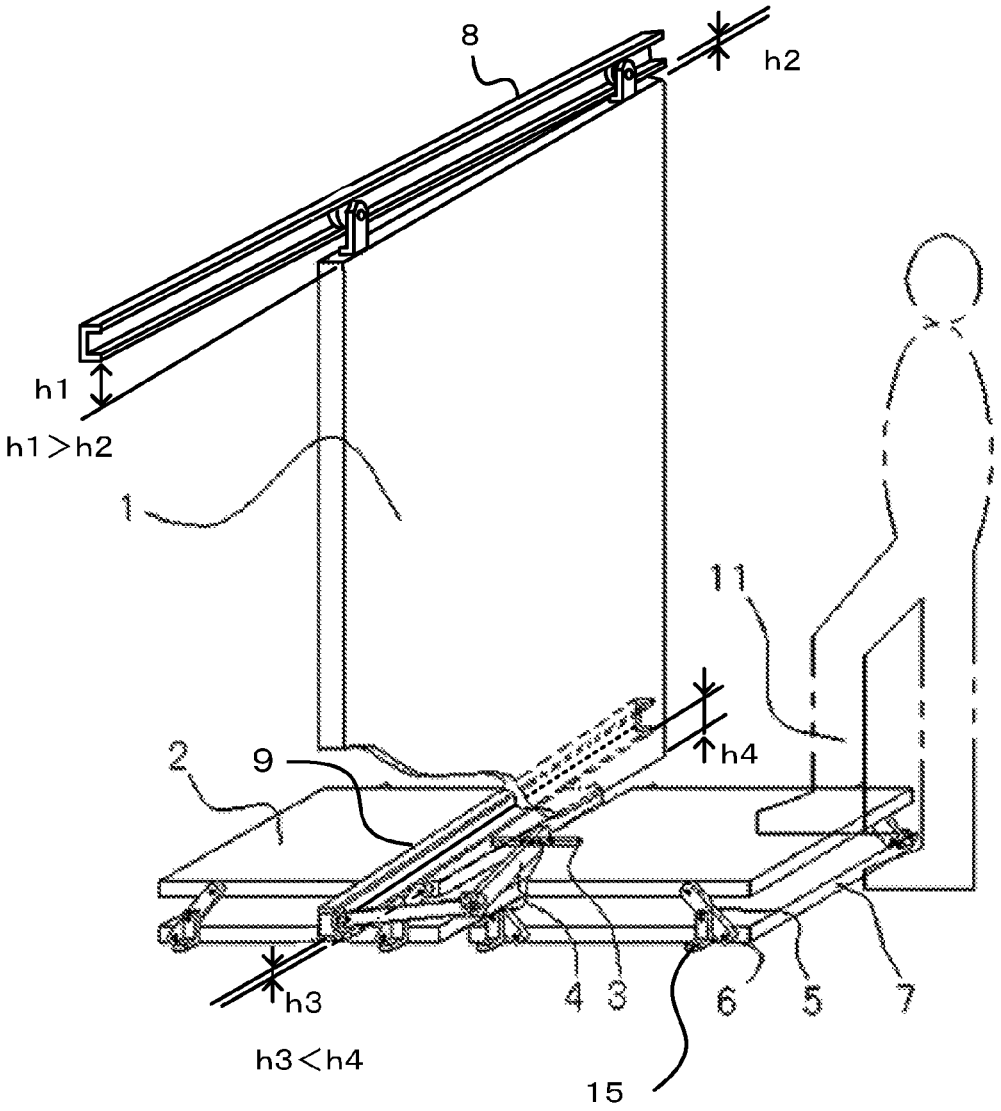
FIG. 1 is an external view of a door-opening/closing device using a step-plate mechanism according to the present invention (Embodiment 1).
Figure 2:
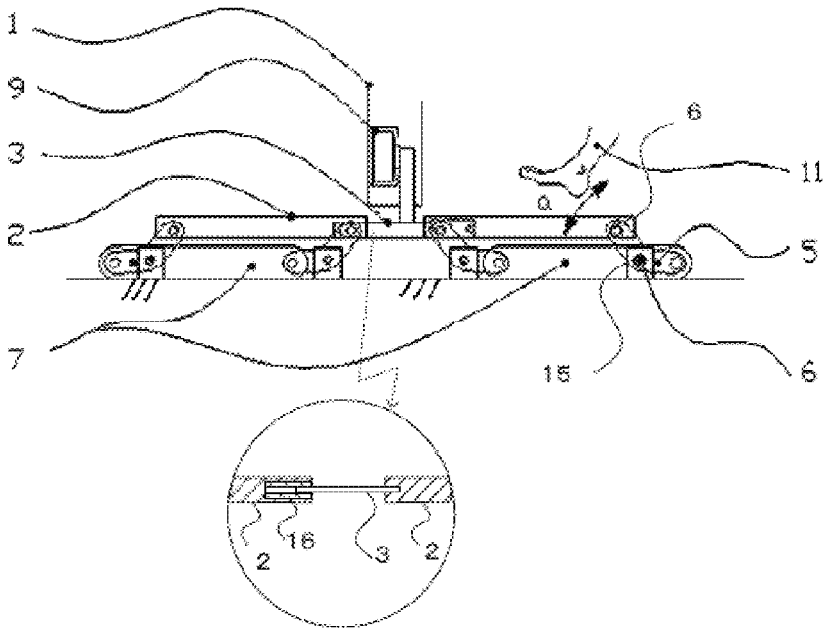
FIG. 2 is a front view of a step-plate mechanism for a door-opening/closing device according to the present invention (Embodiment 1).

Embodiment 1 of the present invention will be explained with reference to FIGS. 1-3. FIG. 1 shows the Embodiment combining a step-plate mechanism (S1) comprising a return mechanism using weights 7, step plates 2, an interlock guide 3, links 5, and bearings 6; and a door-opening/closing mechanism (D) comprising a door 1, a drive arm 4, an overhung-door rail 8 and a guide 9.

Figure 3:
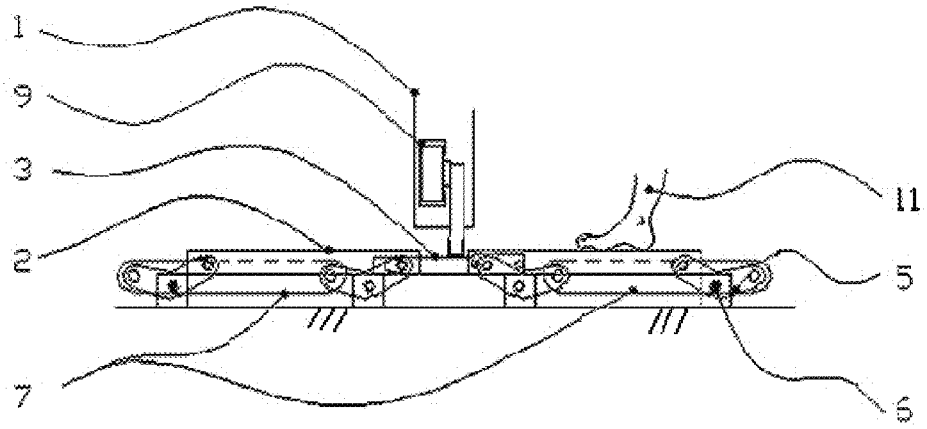
FIG. 3 is a front view of a step-plate mechanism for a door-opening/closing device according to the present invention when a pedestrian steps on the step plate (Embodiment 1).

The step plate 2 in FIG. 1 moves downward as shown in FIG. 3 by the stepping force of a pedestrian coming from the right side in the figures, and that force is transferred to the interlock guide 3, the drive arm 4, and the door-opening/closing mechanism (D). At the same time, the links 5 raise the weights 7 that are mounted to the link extenders (reference number omitted) that extend in the direction opposite from the step plate 2, with the bearings 6 of the metal parts fixed on the floor serving as fulcrum points.

The step plate 2 is raised to return to its original position by the weights 7 moving downward after the pedestrian passes.

If the step-plate mechanism for a door-opening/closing device of the present invention is used in Embodiment 1, there is no need for a mechanism in a door pocket, because the guide 9 that is enclosed in a lower housing works as a drive mechanism. That is, no parts are necessary other than the door 1, the overhung-door rail 8 above the door, and the step-plate mechanism. Here, the overhung-door rail 8 is inclined downward to either the opening direction or closing direction of the door 1. Because the upper end of the door 1 is hung slidably to the overhung-door rail 8, the door 1 can be opened and closing easily.

Because the returning energy is obtained by not mechanical force such as a spring but by weights 7, the performance of which does not change, the power for returning a door is stable for a long time, and the need for inspection and maintenance is reduced.

Embodiment 2

Figure 4:
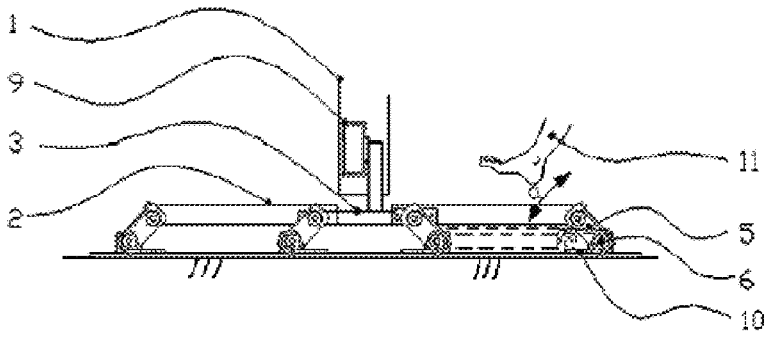
FIG. 4 is a front view of a step-plate mechanism for a door-opening/closing device according to the present invention (Embodiment 2).

There now will be explained in detail with reference to FIGS. 4 and 5 an embodiment of the present invention that combines the step-plate mechanism (S2) for a door-opening/ closing device that uses torsion springs 10 as the return mechanism, and that comprises a step plate 2 on each side of the door 1, each step plate including an interlock guide receiving member 16, an interlock guide 3, links 5 and bearings 6; and the door-opening/closing mechanism (D) that comprises the door 1, a drive arm 4, an overhung-door rail 8, and a guide 9.

Figure 5:
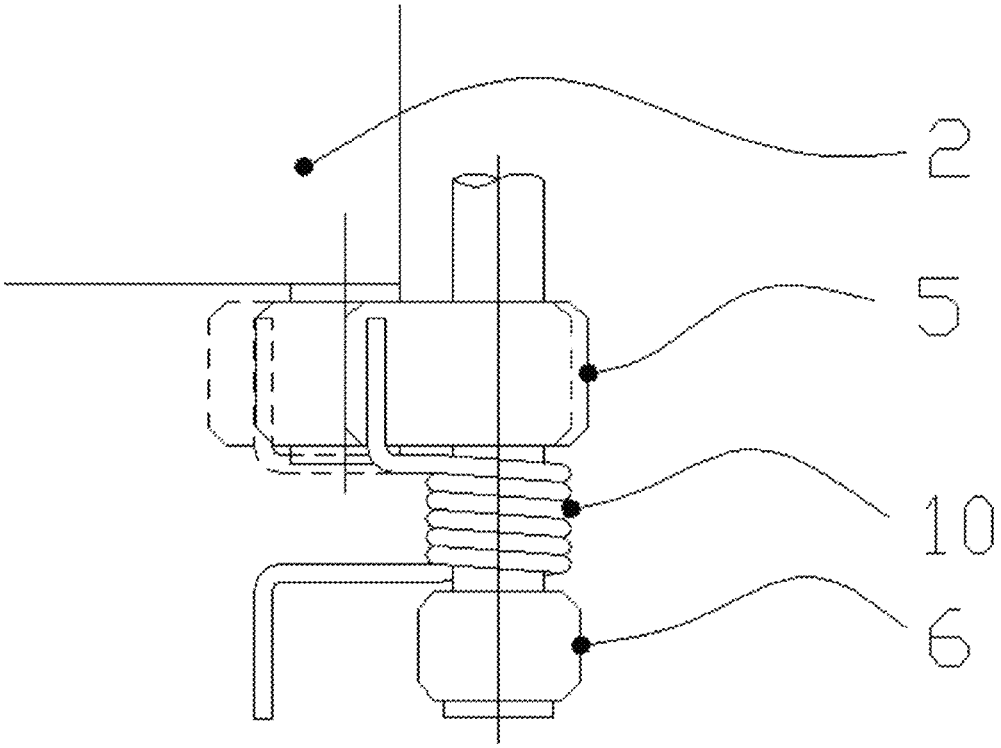
FIG. 5 is a plan view of a link and torsion spring of a step-plate mechanism for a door-opening/closing device according to the present invention (Embodiment 2).

In the present invention's step-plate mechanism for a door-opening/closing device using, as a return mechanism, torsion springs 10, as shown in FIG. 5, instead of the weights 7 of the step-plate mechanism described above, the step plate 2 is returned to its original position by the repelling force of the torsion springs 10, which are mounted coaxially with the bearings 6 disposed in the metal part 15 fixed on the floor, with one end of each torsion spring 10 being fixed to the metal part fixed on the floor, and the other end being fixed to the link 5.

In this way, because a step-plate mechanism having links 5, torsion springs 10, and bearings 6, etc. is disposed on both sides of the step plate 2 and the links 5, the torsion springs 10, and the bearings 6, etc. are not disposed beneath the step plate 2, the step plate 2 can move downward to the bottom of the step-plate mechanism when a pedestrian steps on the step plate 2. Accordingly, the thickness of the step-plate mechanism can be reduced.

Because the thickness of the step-plate mechanism is reduced, it is not necessary to dig a hole in the floor, and if the drive mechanism of Embodiment 2 is used, no special installation work is necessary in erecting a building other than installing an inclined overhung-door rail 8.

In the above embodiment, the step plate 2 remains horizontal and moves downward arcuately in the direction in which the pedestrian is walking, by coupling the bearings 6 of the step plate 2 and the bearings 6 that are disposed in the metal part fixed on the floor by the links 5. However, the present invention can be applied to other types of step-plate mechanisms, using levers or the like, for a door-opening/closing device powered by the downward movement of a step plate 2.

Figure 6:
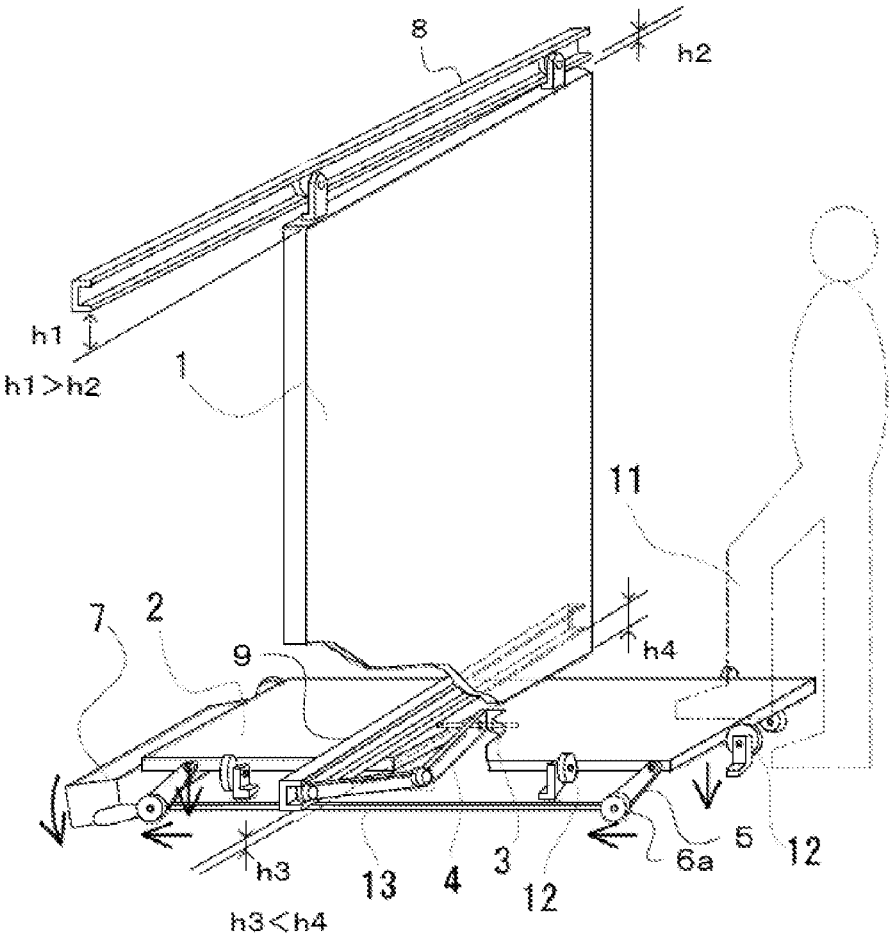
FIG. 6 is an external view of a door-opening/closing device using a step-plate mechanism for a door-opening/closing device of a modification of the present invention.
Figure 7:
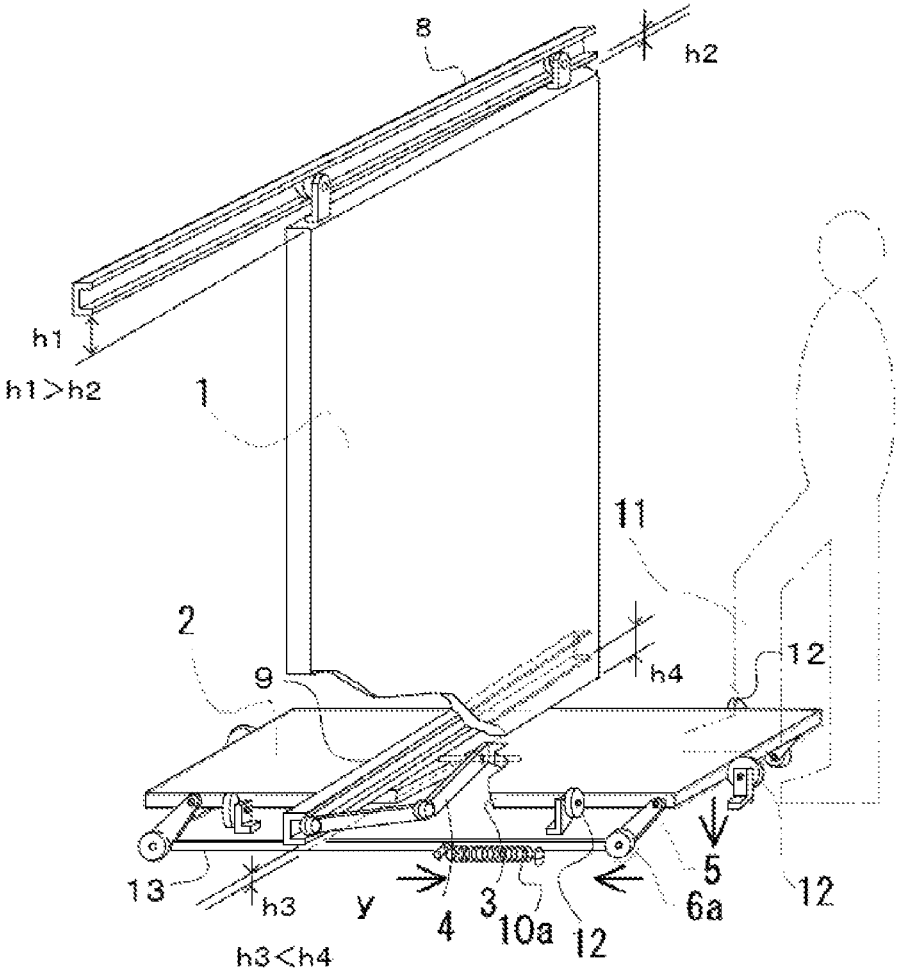
FIG. 7 is an external view of a door-opening/closing device using a step-plate mechanism for a door-opening/closing device of another modification of the present invention.
Figure 8:
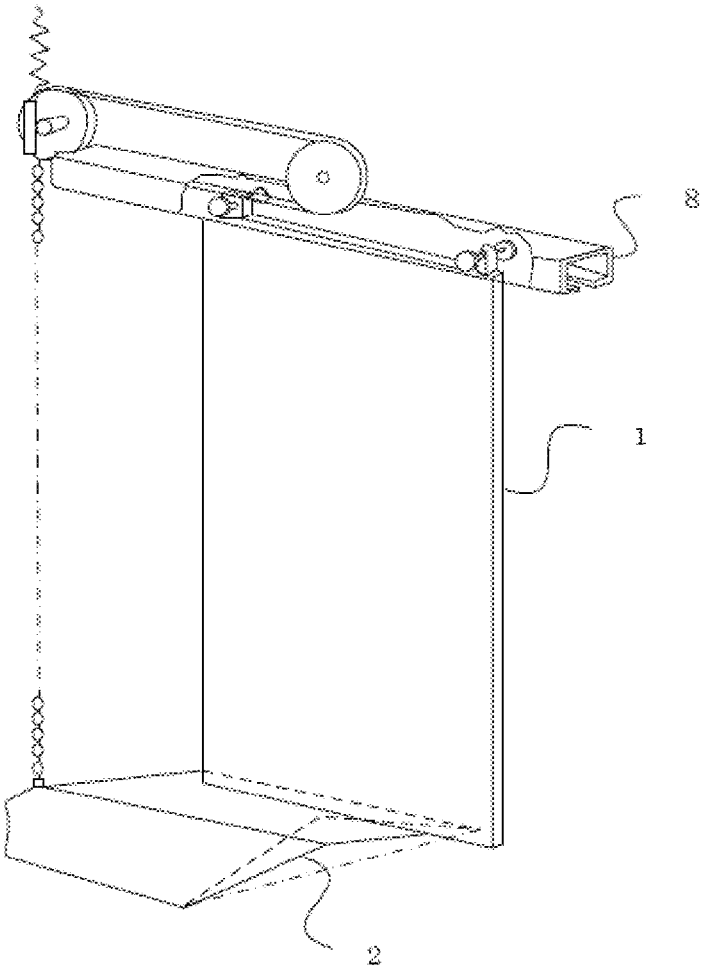
Fig. 8 (Prior Art)
FIG. 8 is an example of the door-opening/closing device disclosed in Japanese Unexamined Patent Application Publication No. H7-208016.
Figure 9:
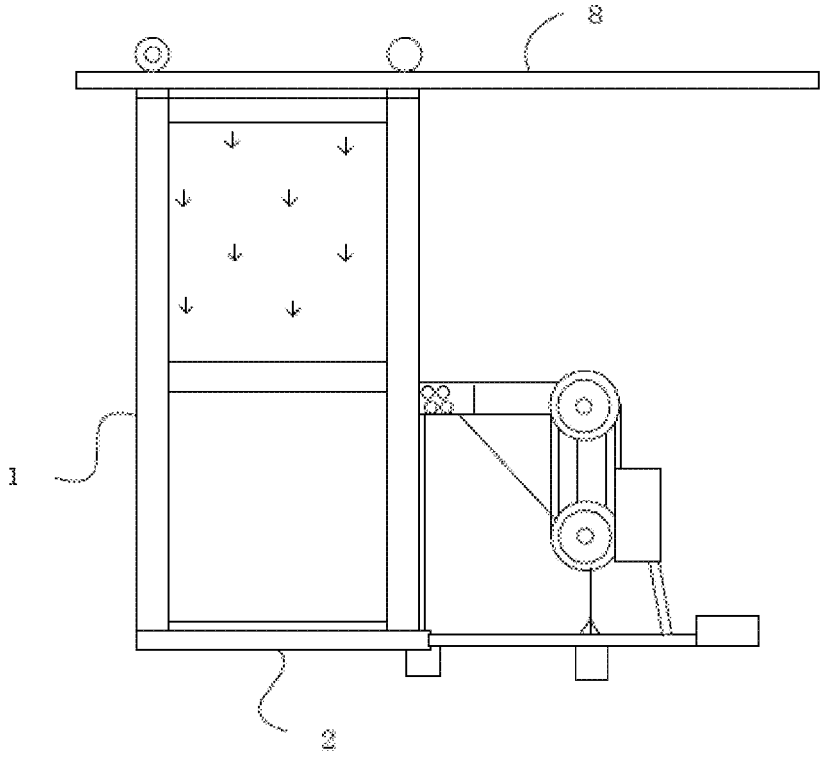
Fig. 9 (Prior Art)
FIG. 9 is an example of the door-opening/closing device disclosed in Japanese Utility Model Application No. 2005-7550.

For example, in a door-opening/closing device in which a step plate 2 moves downward and rises with respect to the floor in a straight or arcuate manner as shown in FIGS. 6 and 7, there can be adopted as a return mechanism (1) a configuration such that the weight 7 rises when the step plate 2 moves downward, and then the weight 7 moves downward and causes the step plate 2 to rise after a pedestrian passes; or (2) a configuration that uses a biasing means such as a spring that accumulates biasing force when the step plate 2 moves downward, and then releases the biasing force when the pedestrian steps off the step plate 2, which causes the step plate 2 to rise.

In the door-opening/closing device shown in FIG. 6, a step plate 2 and a connecting bar 13 are coupled by links 5. A bearing 6*a* is provided in the connecting bar 13. The bearings 6*a* are rotatable and movable on the surface of the floor. A link extender extends from the link 5 at one end of the step plate 2, and a weight 7 is mounted to the link extender. Guides 12 are disposed around the step plate 2 to guide the step plate 2 upward and downward. When the step plate 2 is stepped on by a pedestrian, it moves downward as guided by the guides 12. By this, the force is transferred to the interlock guide 3, the drive arm 4, and the door-opening/closing mechanism (D). At the same time, the connecting bar 13 is moved horizontally by the rotation of the bearings 6*a*. The links 5 raises the weight 7, which is mounted to the link extenders, with the bearings 6*a* of the a metal part fixed on the floor as a fulcrum point. After the pedestrian passes, the downward movement of the weight 7 raises the step plate 2 to its original position.

In the door-opening/closing device shown in FIG. 7, no link extender to which a weight 7 is mounted extends from the link 5, and one end of a coil spring 10*a* is fixed to the connecting bar 13. The other end of the coil spring 10*a* is fixed to the floor. When a pedestrian steps on the step plate 2, it moves downward, guided by the guides 12. By this, the force is transferred to the interlock guide 3, the drive arm 4, and the door-opening/closing mechanism (D). At the same time, the connecting bar 13 moves in the direction of the arrow by the rotation of the bearings 6*a*, which causes the coil spring 10*a* to be extended. After the pedestrian passes, the retraction of the coil spring 10*a* raises the step plate 2 to its original position. By these configurations, the same function and effects as the above embodiments can be obtained.

INDUSTRIAL APPLICABILITY

The present invention's step-plate mechanism for the door-opening/closing device does not use electricity, and is suitable in places where (1) electromagnetic waves would adversely affect human bodies or precision equipment, (2) a lot of water is used and electrical shocks or short circuiting might occur, (3) few pedestrians pass and it is desirable to avoid the need for a source of backup electricity, and (4) many pedestrians holding packages pass by, such as a doorway of a warehouse. Also, this device minimizes the work required to install the device.

EXPLANATION OF NUMBERS USED

1 door
2 step plate
3 interlock guide
4 drive arm
5 link
6 bearing
6*a* bearing
7 weight
8 overhung-door rail
9 guide
10 torsion spring
10*a* coil spring
11 foot of a pedestrian
12 guide
13 connecting bar
S1 step-plate mechanism (Example 1)
S2 step-plate mechanism (Example 2)
D door-opening/closing device

What is claimed is:

1. A step-plate mechanism, the step-plate mechanism comprising: two step plates being disposed on a floor at both front and back sides of a door, each step plate including a plurality of bearings;

multiple links, one end of each link being coupled to a respective one of the bearings of the step plates, wherein each bearing is disposed in a metal part fixed on the floor, and an opposing end of each of the links being coupled to a respective one of the step plates, wherein the step plates, while remaining horizontal, move downward arcuately in a direction of a downward force applied to at least one of the step plates, a return mechanism is provided to bias the links from a displaced position, wherein the ends of the links coupled to the step plates are positioned obliquely downward due to the force applied to the at least one of the step plates to an original position of the ends of the links coupled to the step plates without the force applied to at least one of the step plates, so that the step plates, which move downward due to the force applied to the at least one of the step plates, return to the step plates to an original position thereof after the force is removed from the at least one of the step plates, and wherein one of the step plates has an interlock guide and the other of the step plates has a member configured to receive and slidably connect with the interlock guide, and wherein, when one of the step plates moves downward toward the door in an arcuate path occurring at a constant rate, the other of the step plates also moves downward toward the door in an arcuate path at the constant rate, wherein the movement of the step plates is symmetrical relative to a plane defined by the door, wherein an upper end of the door is slidably hung on an overhung-door rail, and the overhung-door rail is inclined downward in either an opening direction or a closing direction of the door;

a guide provided on the door and being inclined upward in a direction for the overhung-door rail to move down; and a drive arm provided on the guide, wherein one end of the drive arm is connected to the interlock guide and an other end of the drive arm is slidably connected to a groove of the guide, wherein when the step plates are stepped on and move down, the other end of the drive arm moves up, thereby raising and sliding the door in the opening direction.

2. The step-plate mechanism according to claim 1, wherein the return mechanism comprises a link extender in which an end of the link extender extends in a direction opposite from the step plates, and a weight member is axially supported on the end of the link extender; and wherein the weight member rises when the force is applied to at least one of the step plates and the at least one of the step plates moves downward, and when the force is removed from the at least one of the step plates, the weight member moves downward and causes the at least one of the step plates to rise.

3. The step-plate mechanism according to claim 1, wherein the return mechanism comprises a torsion spring that is mounted coaxially with one of the bearings to a shaft disposed in one of the metal parts; and wherein the torsion spring accumulates a biasing force when the downward force is applied to at least one of the step plates and the at least one of the step plates moves downward, and, when the downward force is removed from the at least one of the step plates, the torsion spring releases the biasing force, causing the at least one of the step plates to rise.

* * * * *